US007540357B2

(12) United States Patent
Finn et al.

(10) Patent No.: US 7,540,357 B2
(45) Date of Patent: Jun. 2, 2009

(54) POSITION REFERENCE SYSTEM FOR ELEVATORS

(75) Inventors: Alan Finn, Hebron, CT (US); Jae-Hyuk Oh, Tolland, CT (US); Pei-Yuan Peng, Ellington, CT (US); Chris Pietrzykowski, Unionville, CT (US)

(73) Assignee: Otis Elevator Company, Farmington, CT (US)

( * ) Notice: Subject to any disclaimer, the term of this patent is extended or adjusted under 35 U.S.C. 154(b) by 516 days.

(21) Appl. No.: 10/557,232

(22) PCT Filed: May 15, 2003

(86) PCT No.: PCT/US03/15244

§ 371 (c)(1),
(2), (4) Date: Nov. 15, 2005

(87) PCT Pub. No.: WO2004/106209

PCT Pub. Date: Dec. 9, 2004

(65) Prior Publication Data

US 2006/0243537 A1 Nov. 2, 2006

(51) Int. Cl.
*B66B 1/34* (2006.01)

(52) U.S. Cl. ..... 187/394

(58) Field of Classification Search ..... 187/391, 187/393, 394, 281, 414; 73/158, 862.391, 73/862.392, 862.41, 862.453, 862.473; 324/522, 324/523, 525, 527, 543, 539, 237, 238
See application file for complete search history.

(56) References Cited

U.S. PATENT DOCUMENTS 4,218,671 A * 8/1980 Lewis ..... 187/394
4,427,095 A 1/1984 Payne et al.
4,735,295 A 4/1988 Hochstrasser et al.
5,731,528 A * 3/1998 Yamazaki et al. ..... 73/862.41
5,798,490 A 8/1998 Vairio et al.
5,890,564 A * 4/1999 Olsen et al. ..... 187/250
5,925,859 A 7/1999 Miller et al.
5,992,574 A 11/1999 Olsen et al.
6,286,629 B1 * 9/2001 Saunders ..... 187/394
6,454,054 B1 * 9/2002 Tanino et al. ..... 187/394
6,653,943 B2 * 11/2003 Lamb et al. ..... 340/677
7,117,981 B2 * 10/2006 Logan et al. ..... 187/391
2002/0112926 A1 8/2002 Siberhorn et al.
2004/0174161 A1 * 9/2004 Tausch et al. ..... 324/207.22

FOREIGN PATENT DOCUMENTS

JP 57500241 2/1982
JP 59031274 A 2/1984

(Continued)

OTHER PUBLICATIONS

Japanese Office Action (translation) dated Jan. 20, 2009.

*Primary Examiner*—Jonathan Salata
(74) *Attorney, Agent, or Firm*—Bachman & LaPointe, P.C.

(57) ABSTRACT

A position reference system for use with a conveyance, such as an elevator (12). The system includes a code affixed to or embedded within a suspension device or primary motion coupling such as a rope or coated steel belt (16). A reader (28) in a fixed location determines the position of the conveyance.

5 Claims, 1 Drawing Sheet

FOREIGN PATENT DOCUMENTS

| | | | | |
|---|---|---|---|---|
| JP | 59102780 | A | | 6/1984 |
| JP | 040166471 | A | * | 1/1992 |
| JP | 10180236 | A | | 7/1998 |
| JP | 10318741 | | | 12/1998 |
| JP | 2002-167133 | | | 6/2002 |
| WO | 8102288 | A1 | | 8/1981 |

* cited by examiner

POSITION REFERENCE SYSTEM FOR ELEVATORS

BACKGROUND OF THE INVENTION

The present invention relates generally to elevators and more specifically to a device for determining the position of an elevator car.

Absolute position reference systems are known in the prior art. U.S. Pat. No. 5,023,434 relates to a position indicating apparatus particularly for overhead transport systems. The position indicating apparatus includes an elongated code carrier carrying multi-value code marks along its length. A code reading device secured on a transport carrier, such as a trolley, crane, or other traveling mechanism, reads the code marks on the code carrier. To prevent erroneous reading when the transport carrier and thus the code reading device is tilted or skewed with respect to the code carrier, and to ensure accuracy of position of reading of the code carrier, the code marks are arranged on the code carrier, one next to another in a single row or track, and formed such that "m" of the code marks provides one code word, the code words being positioned one next to each other and appear only once, or are unique along the entire code carrier. The code reader has a reading station, for each bit, with three sets of reading heads per station which are equidistantly distributed by a distance corresponding at least to the number of digits of a code word to provide, upon processing of outputs from all three reading heads, an unambiguous position indication.

U.S. Pat. No. 5,138,560 to Lanfer et al. illustrates a position indicating apparatus which includes a code carrier which carries multi-value code marks in one track along its length. The code marks are combined into blocks with which a block identification is associated. Cooperating with the code carrier and the block identification are a code reader and an auxiliary reader, respectively. Along the travel path, the code carrier and the code reader are disposed counter to one another. To enable increasing the length of the addressable travel paths without losing positional accuracy, or without having to increase the number of code marks in one code word, a block identification is associated with the blocks. From the block identification, an auxiliary reader can recognize whether the code reader is reading only code marks from one block. In this way, the travel path can be divided into important zones, in which the accurate position of the vehicle must be known, and to which blocks must therefore be assigned, and unimportant zones, which are merely gaps between blocks that connect the important zones to one another.

U.S. Pat. No. 5,821,477 to Gerstenkorn illustrates a reflector mounted in an elevator shaft and having coded symbols in two tracks in the region of a stopping floor. Detectors on a car read the coded symbols for bridging door contacts when the car is in the arrival region and the resetting region of the stopping floor. The symbols are detected and evaluated by a two-channel evaluating circuit having optical transmitters for illuminating the tracks and charge-coupled device sensors for detecting the reflected images. A pattern recognition logic system and computers for each channel recognize patterns in the images for generating car position and speed information and for actuating relays to bridge the door contacts.

U.S. Pat. No. 6,435,315 to Zaharia relates to an apparatus for determining the position of an elevator car within a hoistway that includes a code rail containing optically readable indicia that is being mounted within the hoistway adjacent to the path of travel of the car. At least one camera is mounted upon the car for movement therewith for scanning the code rail indicia and providing data indicative of the car's position to the car controllers.

PCT Publication WO 01/83352 to Wegener et al. relates to a device for determining the position of an elevator car during evacuation which includes an endless cable that is connected to the elevator car and provided with marks. A unit for detecting the marks is provided.

While these position referencing systems work well, there is still a need for better systems without additional equipment along the travel path, e.g., elevator hoistway walls.

SUMMARY OF THE INVENTION

It is an object of the present invention to provide a system for determining the position of a conveyance without additional equipment along the travel path walls.

The foregoing object is attained by the position reference system of the present invention.

In accordance with the present invention, a position reference system for providing information about the position of a conveyance, such as an elevator, is provided. The position reference system includes a code affixed to or embedded within a suspension device or primary motion coupling such as a rope or a coated steel belt. The position reference system further includes a reader in a fixed location for reading the code and determining the position of the conveyance.

A method for determining stretch in a primary motion coupling for an elevator car is provided. The method comprises the steps of providing the primary motion coupling with a code, measuring an actual length for each indicia forming the code, detecting changes in the actual length resulting from stretching of the primary motion coupling, and determining the stretch from the detected changes in actual length.

A method for determining slip of an elevator car is also provided. The method broadly comprises the steps of generating drive commands to a primary motion actuator, measuring position of the elevator car after the drive commands using a position reference system including a code on a primary motion coupling attached to the elevator car and a reader for reading the code, and comparing change in position according to the position reference system to change in position according to the drive commands.

Other details of the absolute position reference system of the present invention, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
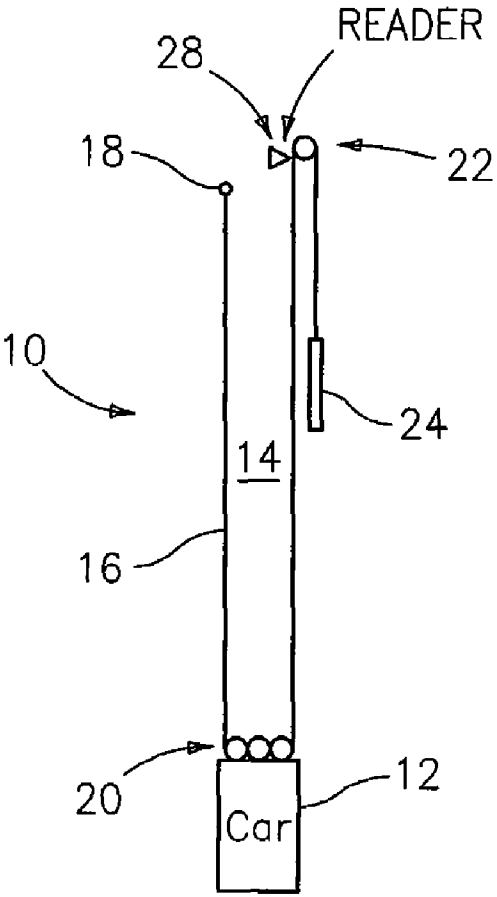
FIG. 1 is a schematic representation of an elevator system including the position reference system of the present invention.

Referring now to FIG. 1, an elevator system 10 comprises an elevator car 12 which moves vertically within a hoistway 14 in a building structure. A primary motion coupling 16 extends from a termination point 18, through idler sheaves 20 attached to the car 12, over a drive sheave 22, to a counterweight 24. The drive sheave 22 may be driven using any suitable means known in the art to move the elevator car 12 vertically in the hoistway between a series of landings (not shown). The primary motion coupling 16 is used to suspend the car 12 and may be a rope, a plurality of ropes, or a coated steel belt (CSB), such as that shown in FIG. 2. Also as shown in FIG. 2, the primary motion coupling 16 may include a plurality of cables 40 and/or a coating 42.

Figure 2:
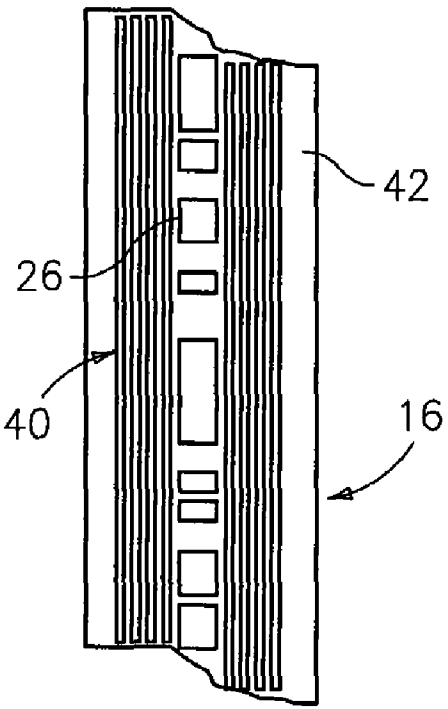
FIG. 2 is a schematic representation of a primary motion coupling used in the position reference system of the present invention.

In accordance with the present invention, the position reference system of the present invention includes a code 26, as shown in FIG. 2, which is affixed or embedded in the primary motion coupling 16. The elevator positioning system further includes a reader 28 at a fixed location. The reader 28 is used to read the code 26 and compute the absolute position, velocity, acceleration, and jerk of the car 12. The reader 28 may comprise any suitable reader known in the art. The type of reader 28 which will be used will be a function of the nature of the code 26.

The code 26 and the reader 28 may also be used to directly measure the stretch or slip of the primary motion coupling 16 of the elevator car 12. Stretch may be measured by direct measurement of the code. The code, when applied to a new primary motion coupling, will be of known length. Should the primary motion coupling stretch due to load or wear, the code indicia will stretch similarly. High resolution signal processing algorithms as well known in the art may be applied to measure the actual length of the code indicia and thereby directly measure stretch. Slip may be measured by comparison of the measured position to the drive commands. The controller of a conveyance uses feedback from a position reference system to generate drive commands to the primary motion actuator to affect position control of the conveyance. Ideally, the drive commands correspond exactly to a change in position. However, any slippage between the drive actuator and primary motion coupling results in a discrepancy between the change in position according to the position reference system and the change in position according to the drive commands, provided that the position reference system is independent of slippage. This discrepancy is a direct measure of slippage and slippage corresponds to wear on the primary motion actuator and primary motion coupling.

In a preferred embodiment of the present invention, the reader 28 is positioned along the primary motion coupling 16 at a fixed location between the drive sheave 22 and the termination point 18. In this way, drive sheave slip is immaterial to the position measurement. Therefore, from the difference between the absolute position measurement and the drive commands, slip and corresponding wear may be calculated. This calculation may be through a look-up table, its equivalent functional representation, or by any of a variety of means well known in the art.

Compensation for stretch of the primary motion coupling 16 may be directly measured from the code 26 or may be estimated by an empirical function of load and temperature based on primary motion coupling tests. Depending on the accuracy of this estimation, a separate sill sensor (not shown) may be needed. If so, then that information could be used in the estimation algorithm to improve position accuracy.

The code 26 may be embedded in the primary motion coupling 16, such as a coated steel belt, in a variety of different ways. For example, the code 26 may be physical, optical, or magnetic marks or materials on the surface of the primary motion coupling 16. It might be advantageous to have the marks along the edge of the primary motion coupling 16 since the edge is not in contact with either the drive sheave 22 or the idler sheaves 20, thus minimizing wear. Physical marks, such as grooves, are not preferred on the surface of the primary motion coupling 16 due to possible induced noise. However, grooves of a given location, distribution, shape, etc., might be designed to an acceptable noise level, e.g. less than 48 dB, and therefore permit their use as the codes for a position reference system.

The code 26 may be physical, optical, or magnetic marks or materials embedded in the coating 42 of a primary motion coupling 16 such as the coated belt shown in FIG. 2. This means the primary motion coupling 16 may have to be slightly wider with no cables under a section of the coating, preferably in the middle. The embedded code 26 may be holes cut through the primary motion coupling 16. Alternatively, the primary motion coupling 16, such as the belt shown in FIG. 2, may be fabricated in a laminated manner with one layer containing the code 26.

The code 26 may also be an additional cable or cord in the primary motion coupling 16, such as the belt shown in FIG. 2, with material properties that may be sensed through a coating, such as the belt coating 42.

The code 26 may also be changes or enhancements to one or more of the cables 40 within the primary motion coupling 16, such as the cables 40 within the belt shown in FIG. 2, with material properties that may be sensed through a coating, such as belt coating 42.

The most preferred embodiment of the code 26 comprises magnetic materials embedded in a coating on a primary motion coupling 16, such as the belt coating 42. If these materials are sensitive to imposed magnetic fields, e.g. ferric oxide, then the entire primary motion coupling 16 such as a coated steel belt, becomes a magnetic tape. In this case, the reader 26 might also write, rewrite, or otherwise encode information on the belt.

Although the preferred embodiment uses an encoding on a suspension means between a moving cab and a fixed drive system, the invention will work equally well for a drive system attached to the moving car 12 with suspension means attached to a fixed location.

Using the position referencing system of the present invention, there would be an installation savings over any approach that required separate hoistway equipment. An additional savings accrues from reduced inventory for the alternative equipment that is not needed. It is preferred that all encoded primary motion couplings be identical so as not to increase parts count.

While the present invention has been described in the context of an elevator system, the position reference system of the present invention could be used on other conveyances.

It is apparent that there has been provided in accordance with the present invention a device and method for absolute position reference system which fully satisfies the objects, means, and advantages set forth hereinbefore. While the present invention has been described in the context of specific embodiments thereof, other alternatives, variations and modifications will become apparent to those skilled in the art having read the foregoing description. Accordingly, it is intended to embrace those alternatives, modifications, and variations as fall within the broad scope of the appended claims.

What is claimed is:

1. A position reference system for use in a conveyance system to determine the position of an elevator car with respect to a fixed reference location, said system comprising:

a code on a primary motion coupling of said elevator car a reader for reading said code; and said primary motion coupling comprising a belt and said code comprises holes cut through said belt.

2. A position reference system according to claim 1, wherein said reader is mounted within a hoistway in a position between a termination point of said primary motion coupling and a drive sheave.

3. A position reference system for use in a conveyance system to determine the position of an elevator car with respect to a fixed reference location, said system comprising:

a code on a primary motion coupling of said elevator car;

a reader for reading said code; and said primary motion coupling comprising a laminated belt with said code being contained within one layer.

4. A position reference system for use in a conveyance system to determine the position of an elevator car with respect to a fixed reference location, said system comprising:

a code on a primary motion coupling of said elevator car;

a reader for reading said code; and said primary motion coupling comprises comprising a belt and said code comprises at least one of a cable and cord in the belt having material properties that may be sensed through a coating on the belt.

5. A position reference system for use in a conveyance system to determine the position of an elevator car with respect to a fixed reference location, said system comprising:

a code on a primary motion coupling of said elevator car;

a reader for reading said code; and said primary motion coupling comprising a coated belt and said code comprises magnetic materials embedded in the belt coating.

* * * * *

UNITED STATES PATENT AND TRADEMARK OFFICE

CERTIFICATE OF CORRECTION

PATENT NO. : 7,540,357 B2
APPLICATION NO. : 10/557232
DATED : June 2, 2009
INVENTOR(S) : Alan Finn et al.

It is certified that error appears in the above-identified patent and that said Letters Patent is hereby corrected as shown below:

In column 4, claim 1, line 4, after "car" --;-- should be inserted.

In column 6, claim 4, line 2, the word "comprises" should be deleted.

Signed and Sealed this

Twenty-seventh Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,540,357 B2
APPLICATION NO. : 10/557232
DATED : June 2, 2009
INVENTOR(S) : Alan Finn et al.

It is certified that error appears in the above-identified patent and that said Letters Patent is hereby corrected as shown below:

In column 4, claim 1, line 64, after "car" --;-- should be inserted.

In column 6, claim 4, line 2, the word "comprises" should be deleted.

This certificate supersedes the Certificate of Correction issued October 27, 2009.

Signed and Sealed this

Seventeenth Day of November, 2009

David J. Kappos

David J. Kappos
*Director of the United States Patent and Trademark Office*